US006345709B1

(12) United States Patent
Cheng

(10) Patent No.: US 6,345,709 B1
(45) Date of Patent: Feb. 12, 2002

(54) SUITCASE WITH TWO U-SHAPED RUBBER STRIPS

(75) Inventor: Koon-Ming Cheng, Taipei (TW)

(73) Assignee: Ruey Yuan Co., Ltd., Taipei (TW)

( * ) Notice: Subject to any disclaimer, the term of this patent is extended or adjusted under 35 U.S.C. 154(b) by 0 days.

(21) Appl. No.: 09/596,474

(22) Filed: Jun. 16, 2000

(51) Int. Cl.[7] ..... A45C 13/10
(52) U.S. Cl. ..... 190/119; 190/126; 190/903
(58) Field of Search ..... 190/103, 119, 190/126, 903

(56) References Cited

U.S. PATENT DOCUMENTS 3,266,604 A * 8/1966 Kish, Jr. ..... 190/119
3,443,671 A * 5/1969 Dyke ..... 190/103
3,477,553 A * 11/1969 Kish, Jr. ..... 190/119
4,031,723 A * 6/1977 Samhammer et al. ..... 190/119
4,083,089 A * 4/1978 Minami ..... 190/119
5,111,919 A * 5/1992 Hamatani et al. ..... 190/903 X

* cited by examiner

*Primary Examiner*—Stephen K. Cronin
(74) *Attorney, Agent, or Firm*—Christie, Parker & Hale, LLP

(57) ABSTRACT

A suitcase includes two generally rectangular housing halves, two U-shaped rubber strips, and a zipper unit. Each of the housing halves has first, second, third and fourth sides. The housing halves are interconnected rotatably at the first sides. Each of the rubber strips has an inner side, and an outer side that is fastened to a respective one of the housing halves and that extends along the second, third and fourth sides of the respective one of the housing halves. The zipper unit includes two interengaged zipper halves that are fastened respectively to the rubber strips, and that are covered by the rubber strips, respectively.

1 Claim, 3 Drawing Sheets

SUITCASE WITH TWO U-SHAPED RUBBER STRIPS

BACKGROUND OF THE INVENTION

1. Field of the Invention

The invention relates to a suitcase, more particularly to a suitcase which has two U-shaped rubber strips.

2. Description of the Related Art

A conventional suitcase is usually provided with two circular-cross-sectioned plastic tubes along the peripheries of two side walls thereof in order to enhance the appearance of the suitcase. However the plastic tubes wear easily when hit against or slide across the floor. Furthermore, since the cross-section of the plastic tubes is circular, it is difficult to stitch the plastic tubes onto the suitcase.

SUMMARY OF THE INVENTION

Therefore, the object of the present invention is to provide a suitcase with two U-shaped rubber strips to overcome the aforesaid drawbacks commonly associated with the prior art.

A suitcase according to this invention includes two generally rectangular housing halves, two U-shaped rubber strips, and a zipper unit. Each of the housing halves has first, second, third and fourth sides. The housing halves are interconnected rotatably at the first sides. Each of the rubber strips has an inner side, and an outer side that is fastened to a respective one of the housing halves and that extends along the second, third and fourth sides of the respective one of the housing halves. The zipper unit includes two interengaged zipper halves that are fastened respectively to the inner sides of the rubber strips, and that are covered by the rubber strips, respectively.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENTS

Figure 1:
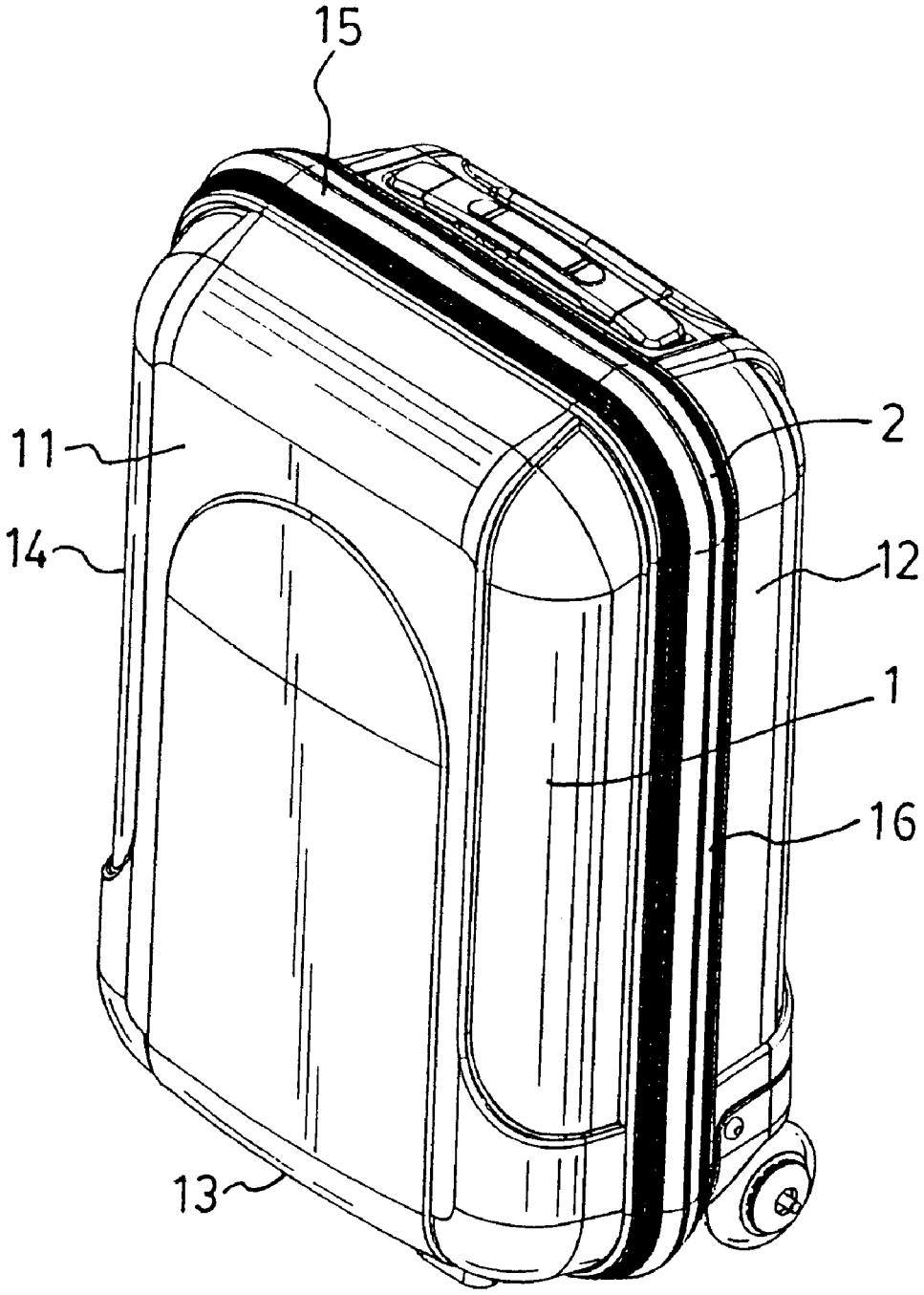
FIG. 1 is a schematic side view of the preferred embodiment of a suitcase according to the present invention.
Figure 2:
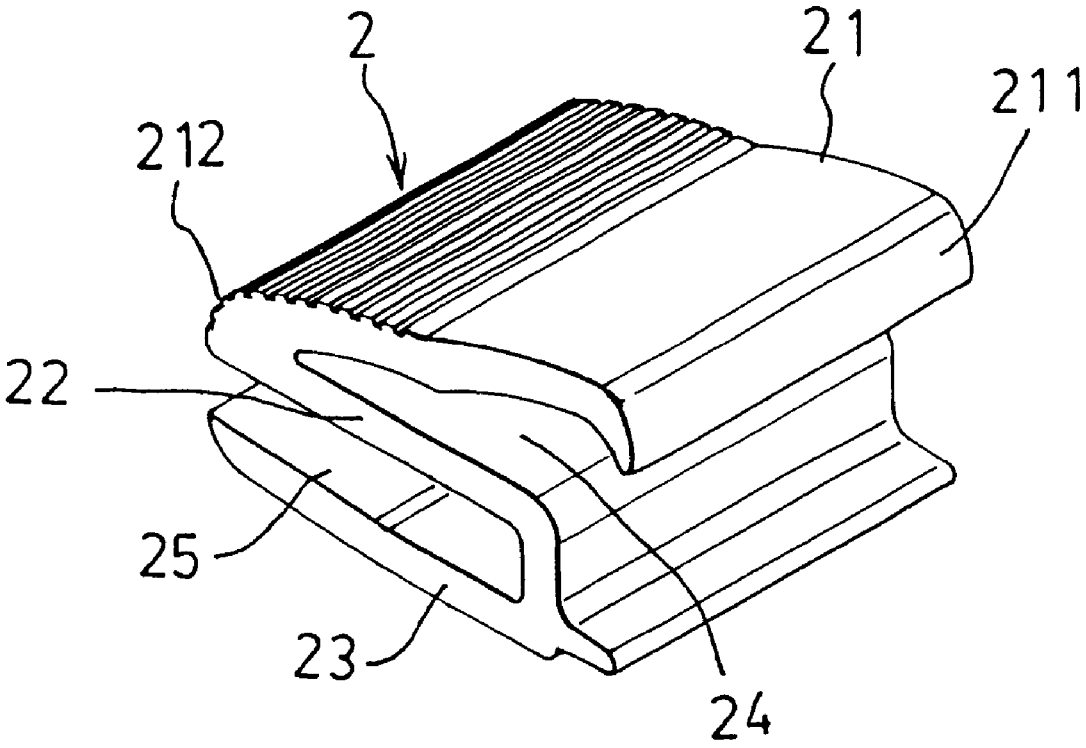
FIG. 2 is a fragmentary perspective view of a rubber strip of the preferred embodiment.
Figure 3:
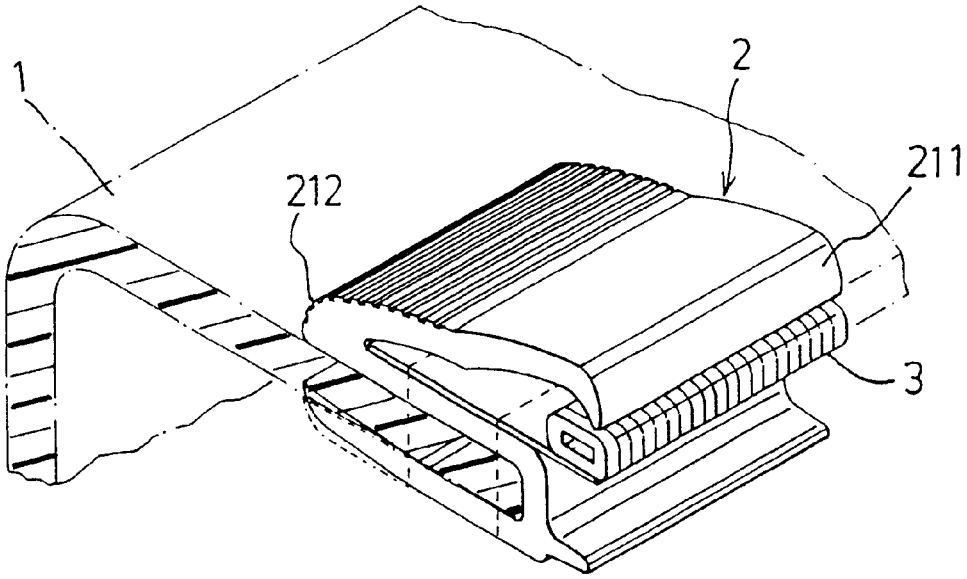
FIG. 3 is a schematic perspective view illustrating how the rubber strip of the preferred embodiment is mounted on the suitcase.
Figure 4:
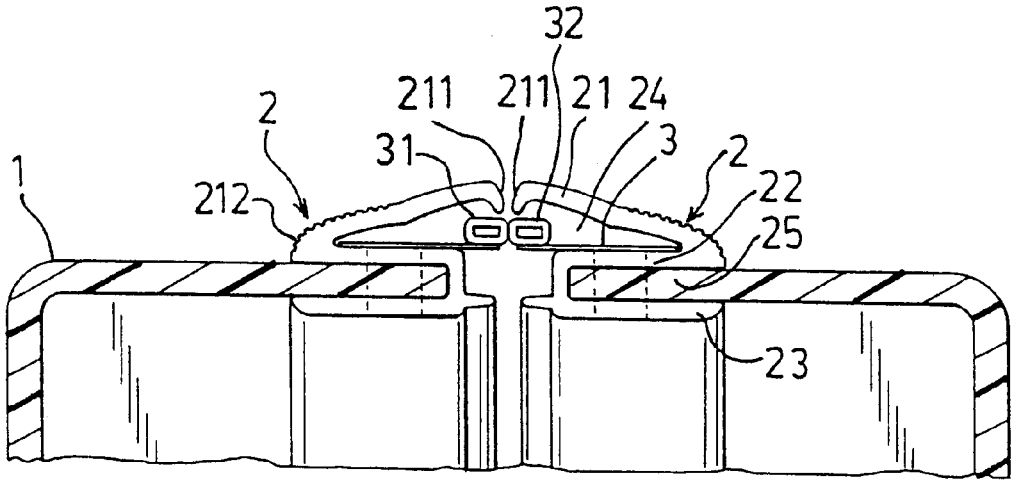
FIG. 4 is a cross-sectional view of a portion of the preferred embodiment.

Referring to FIGS. 1, 2, 3 and 4, a suitcase 1 includes two generally rectangular housing halves 11, 12, two U-shaped rubber strips 2 and a zipper unit 3. Each of the housing halves 11, 12 has first, second, third and fourth sides 13, 14, 15, 16. The housing halves 11, 12 are interconnected rotatably at the first sides 13. Each of the rubber strips 2 has an inner side 211, and an outer side 212 that is fastened to a respective one of the housing halves 11, 12 and that extends along the second, third and fourth sides 14, 15, 16 of the respective one of the housing halves 11, 12. The zipper unit 3 includes two interengaged zipper halves 31, 32 that are fastened respectively to the inner sides 211 of the rubber strips 2, and that are covered by the rubber strips 2. Each of the rubber strips 2 includes an inner strip section 23, an outer strip section 21 for covering a respective one of the zipper halves 31, 32, and a generally L-cross-sectioned connecting strip section 22 that interconnects the inner and outer strip sections 23, 21.

Each of the rubber strips 2 has an inner side surface and is formed with an inner slot 24. The inner slot 24 is defined between the outer strip section 21 and the connecting strip section 22. The zipper halves 31, 32 are stitched respectively within the inner slots 24 in the rubber strips 2. Each of the rubber strips 2 further has an outer side surface formed with an outer slot 25. The outer slot 25 is defined between the inner strip section 23 and the connecting strip section 22. The housing halves 11, 12 are stitched respectively within the outer slots 25 in the rubber strips 2.

The suitcase 1 of this invention has the following advantages:

(1) When the second, third and fourth sides 14, 15, 16 of the housing halves 11, 12 hit against or slide across the floor, the rubber strips 2 serve as cushions to prevent damage of the suitcase 1.

(2) The rubber strips can be stitched easily onto the housing halves 11, 12 and the zipper unit 3.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A suitcase comprising:

two generally rectangular housing halves, each of which has first, second, third and fourth sides, said housing halves being interconnected rotatably at said first sides;

two U-shaped rubber strips, each of which has an inner side with an inner side surface formed with an inner slot, and an outer side with an outer side surface formed with an outer slot, within which the respective one of said housing halves is fastened by stitching to a respective one of said housing halves and that extends along said second, third and fourth sides of the respective one of said housing halves; and a zipper unit including two interengaged zipper halves that are fastened by stitching respectively to said inner slot of said rubber strips and that are covered by said rubber strips wherein each of said rubber strips includes an inner strip section, an outer strip section for covering a respective one of said zipper halves, and a generally L-cross-sectioned connecting strip section that interconnects said inner and outer strip sections, said inner slot being defined between said outer strip section and said connecting strip section, said outer slot being defined between said inner strip section and said connecting strip section.

* * * * *